United States Patent [19]

Yamaguchi et al.

[11] 4,171,622

[45] Oct. 23, 1979

[54] HEAT PUMP INCLUDING AUXILIARY OUTDOOR HEAT EXCHANGER ACTING AS DEFROSTER AND SUB-COOLER

[75] Inventors: Koichiro Yamaguchi; Makoto Obata, both of Kadoma; Mitsuo Ogawa, Higashi-Osaka, all of Japan

[73] Assignees: Matsushita Electric Industrial Co., Limited, Matsushita Reiki Company, Limited, both of Japan

[21] Appl. No.: 820,003

[22] Filed: Jul. 28, 1977

[30] Foreign Application Priority Data

Jul. 29, 1976 [JP] Japan ..... 51-90922
Sep. 13, 1976 [JP] Japan ..... 51-110257

[51] Int. Cl.[2] ..... F25B 13/00; F25B 47/00

[52] U.S. Cl. ..... 62/160; 62/81; 62/278; 62/324; 62/526

[58] Field of Search ..... 62/160, 81, 86, 278, 62/324, 524, 526

[56] References Cited

U.S. PATENT DOCUMENTS

| | | | |
|---|---|---|---|
| 2,148,413 | 2/1939 | Labberton et al. | 62/524 X |
| 2,148,415 | 2/1939 | Labberton | 62/160 |
| 2,627,730 | 2/1953 | Zearfoss, Jr. | 62/278 |
| 2,649,701 | 8/1953 | Del Signore | 62/280 |
| 2,806,674 | 9/1957 | Biehn | 62/160 X |
| 2,860,491 | 11/1958 | Goldenberg | 62/160 X |
| 2,926,503 | 3/1960 | Neubauer | 62/278 X |
| 2,998,712 | 9/1961 | Watkins | 62/81 X |
| 3,005,320 | 10/1961 | Bodell | 62/160 |
| 3,024,620 | 3/1962 | Burnett | 62/278 |
| 3,052,102 | 9/1962 | McMillan | 62/160 X |
| 3,132,490 | 5/1964 | Schmidt | 62/160 |
| 3,150,501 | 9/1964 | Moore | 62/324 X |
| 3,423,954 | 1/1969 | Harnish et al. | 62/160 X |
| 3,520,147 | 7/1970 | Glackman | 62/160 X |
| 3,529,659 | 9/1970 | Trask | 62/160 X |
| 3,869,874 | 3/1975 | Ditzler | 62/278 |
| 3,977,210 | 8/1976 | Bruguier | 62/324 |
| 4,057,977 | 11/1977 | Chambless | 62/324 |
| 4,066,118 | 1/1978 | Goettl | 62/160 X |

FOREIGN PATENT DOCUMENTS

| | | | |
|---|---|---|---|
| 165047 | 7/1954 | Australia | 62/160 |
| 1240474 | 7/1960 | France | 62/324 |

*Primary Examiner*—Leslie Braun
*Attorney, Agent, or Firm*—Lowe, King, Price & Becker

[57] ABSTRACT

A heat pump including an indoor heat exchanger, a main outdoor heat exchanger and an auxiliary outdoor heat exchanger provided underneath the main outdoor heat exchanger and connected between the indoor and main outdoor heat exchangers in a closed refrigerant flow circuit. The refrigerant flow circuit includes a compressor and a reversal valve which can be adjusted (1) during cooling operation to direct the hot compressed gaseous refrigerant from the compressor to the main outdoor heat exchanger and thence to the auxiliary heat exchanger acting as a sub-cooler into the indoor heat exchanger for extracting heat from air of the interior of a building and (2) during heating operation to direct the hot compressed gaseous refrigerant to the indoor heat exchanger to supply heat to the indoor air and then to the auxiliary heat exchanger now acting as a defroster for melting a block of ice which may have accumulated under the main outdoor heat exchanger and into the main outdoor heat exchanger.

9 Claims, 7 Drawing Figures

HEAT PUMP INCLUDING AUXILIARY OUTDOOR HEAT EXCHANGER ACTING AS DEFROSTER AND SUB-COOLER

FIELD OF THE INVENTION

This invention relates to heat pumps of the type which are capable of taking heat from the interior of a building and dissipating the heat outside during warm weather, and which can be adjusted to be capable of taking heat from the outside atmosphere and supplying the heat to air in the interior which the pump is required to heat during cold weather.

DESCRIPTION OF THE PRIOR ART

The known heat pump comprises a compressor which compresses a refrigerant in the gaseous phase thereby raising the temperature of the refrigerant, an indoor heat exchanger or coil, an outdoor heat exchanger or coil and piping including a reversal valve which can be adjusted to connect the discharge side of the compressor either to the indoor heat exchanger or the outdoor heat exchanger and simultaneously to connect the suction side of the compressor to the other heat exchanger.

When the outdoor coil is absorbing heat from the surrounding nearby outside atmosphere the temperature of the coil is lower than that of the outside atmosphere and as heat flows from the surrounding nearby outside atmosphere to the coil, and to the refrigerant within the coil, the temperature of the portion of the outside atmosphere from which heat is being extracted, falls, thus causing its relative humidity and dew point to rise until moisture condenses upon the outdoor coil and adjacent metallic parts. If the temperature is above the freezing point of water the condensate is in the form of water. If the temperature is below the freezing point of water the condensate takes the form of frost which may grow to become a heavy block or layer of ice that is liable to accumulate beneath the outdoor coil, which would tend to interfere with the proper operation of the heat pump.

U.S. Pat. No. 3,024,620 discloses a heat pump which additionally includes a defroster in the closed loop refrigerant flow circuit wherein the direction of flow of refrigerant is periodically reversed for relatively brief intervals so that hot compressed gaseous refrigerant directly flows from the discharge side of the compressor into the defroster. The heat from the defroster is transferred to the lower part of the outdoor coil and a block of ice which may have built up there is thawed. However, the thawing of ice is only achieved at the expense of the energy which would have been used for supplying heat to air in the interior.

It is desirable that the heat pump be capable of high efficiency operation during cooling cycle operation as well as during heating cycle operation. U.S. Pat. No. 2,649,701 discloses an air conditioning unit including an evaporator, a condenser operatively associated with the evaporator and adapted to receive refrigerant therefrom, a sub-cooling coil adapted to receive refrigerant in liquid form substantially free of gas from the condenser, and a line for delivering liquid refrigerant from the sub-cooling coil to the evaporator. Moisture precipitated from the air by evaporator is collected in a sump and the water in the sump is flung centrifugally by a slinger upon the sub-cooler, the water tending to spread around the sub-cooling coil to permit operation in a wet condition with high transfer rates thereby utilizing moisture condensed by the evaporator from the air being cooled to sub-cool liquid refrigerant prior to its supply to the evaporator.

SUMMARY OF THE INVENTION

The primary object of the present invention is to provide an auxiliary outdoor heat exchanger which is constructed along the main outdoor heat exchanger and connected between the main outdoor heat exchanger and an indoor heat exchanger in a closed refrigerant flow circuit, wherein the auxiliary heat exchanger acts as a defroster during heating operation and as a sub-cooler during cooling operation.

Another object of the invention is to utilize the maximum heat transfer capability of the heat exchangers so that the defroster is in a high heat transfer relationship with the main heat exchanger during heating operation.

A further object of the invention is to provide an improved heat pump in which a liquid receiver and a one-way restricted passage are provided in series between the auxiliary outdoor heat exchanger and the main outdoor heat exchanger, whereby the refrigerant liquefied by the main outdoor heat exchanger acting as a condenser during cooling operation is passed freely through the one-way restricted passage to the liquid receiver from whence the liquid refrigerant completely free from gas flows into the auxiliary outdoor heat exchanger acting as a sub-cooler.

A still further object of the invention is to provide an improved heat pump which is capable of operation throughout a wide range ambient temperatures during heating operation.

BRIEF DESCRIPTION OF THE DRAWINGS

These and other objects, features and advantages of the invention will be understood from the following description taken in conjunction with the accompanying drawings, in which.

DESCRIPTION OF THE PREFERRED EMBODIMENTS

Figure 1:
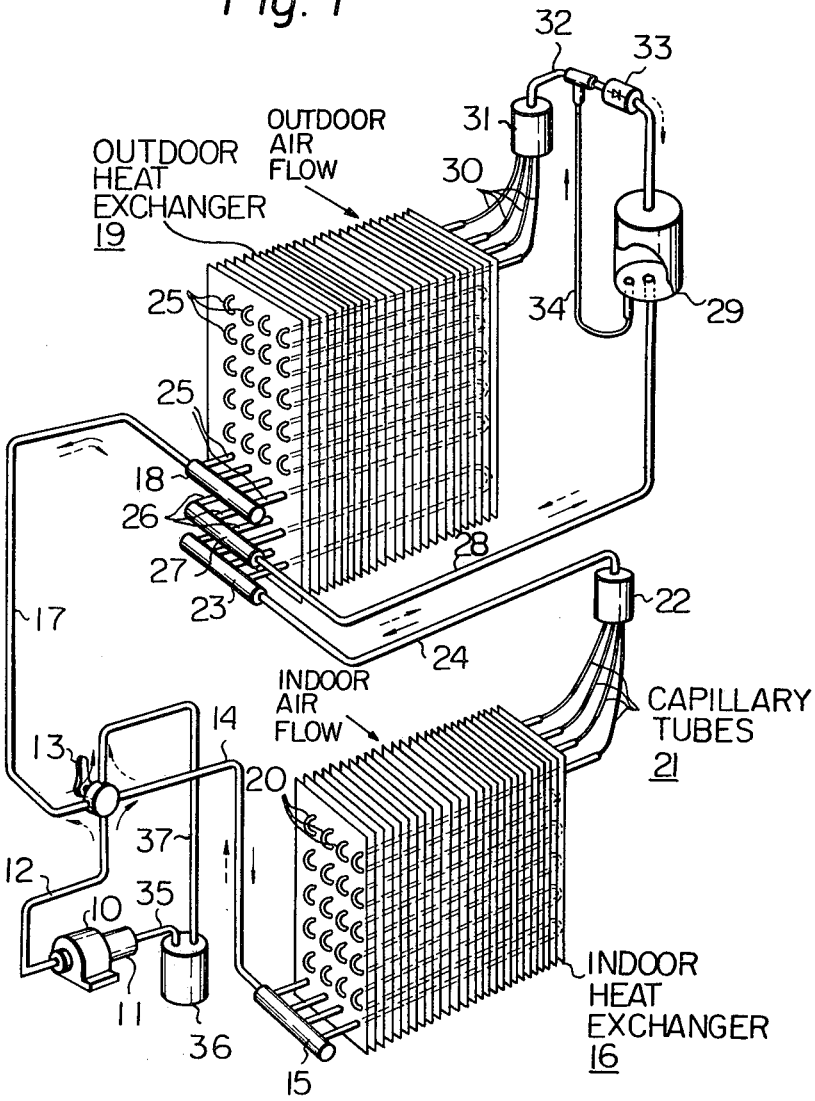
FIG. 1 is a diagrammatic view of a heat pump embodying the present invention.

In FIG. 1, a hermetically sealed refrigerant compressor 10 driven by the built-in electric motor 11 has its discharge side connected through tube 12 to a conventional reversal valve 13. During air heating operation, the valve 13 is adjusted to route the refrigerant through tube 14 to the header 15 of an indoor heat exchanger 16. The solid line arrows alongside the tubing indicate the direction of the flow of refrigerant during heating operation. During cooling operation, the valve 13 is adjusted to direct the refrigerant through tube 17 to the header 18 of an outdoor heat exchanger 19. The broken-line arrows alongside the tubing indicate the direction of refrigerant flow during cooling operation.

For purposes of illustration, the indoor heat exchanger 16 has four vertical rows 20 of finned tubes which are exposed to the indoor air and act as a condenser during heating operation and as an evaporator during cooling operation.

The upper tubes of the rows 20 are connected through four capillary tubes 21 to a distributor/filter 22 which is connected to the header 23 of the outdoor heat exchanger 19 through pipe 24. The outdoor heat exchanger 19 has four vertical rows 25 of finned tubes forming the main outdoor heat exchanger, and has additional finned tubes 26 located below the tubes 25 of the main heat exchanger and connected from the header 23 to the header 27 which is connected through pipe 28 to a liquid receiver 29 forming an auxiliary outdoor heat exchanger which acts as a sub-cooler during cooling operation and as a defroster during heating operation. The bottom tubes of the rows 25 are connected to the header 18 and the top tubes of the rows 25 are connected through capillary tubes 30 to a distributor/filter 31 which is connected through pipe 32 and a check valve 33 to the top wall of liquid receiver 29 from the bottom wall of which a capillary tube 34 leads to a junction between the distributor 31 and the check valve 33. The compressor 10 has its suction side connected through pipe 35 to an accumulator 36 which is connected through pipe 37 to the reversal valve 13.

COOLING OPERATION OF FIG. 1

Figure 2:
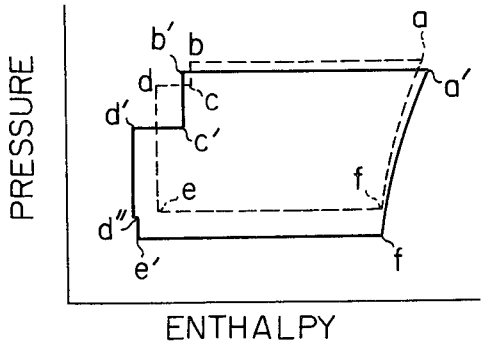
FIG. 2 is a graphic representation of refrigerant pressure versus enthalpy relation in a Mollier diagram.

During cooling operation, the reversal valve 13 routes the refrigerant in the direction indicated by the broken-line arrows along the tubing. The hot compressed gaseous refrigerant flows from the compressor discharge side through the reversal valve 13, through tube 17 to the header 18 into the bottom tubes of the main outdoor heat exchanger acting as a condenser at this time, then out the top tubes of the heat exchanger 19, then through capillary tubes 30 and into distributor 31. The cooling operation of FIG. 1 will be better understood by reference to a Mollier diagram shown in FIG. 2. The refrigerant discharged from the compressor 10 is in gaseous phase at a high pressure and a high value of enthalpy as indicated at a in the Mollier diagram. The gaseous refrigerant is liquefied in the heat exchanger 19 acting as a condenser by the air drawn by means of a fan (not shown) as it passes through the tubes of each vertical row which is connected to each capillary tube 30. The pressure of the liquefied refrigerant in the condenser has the same value as at a, but the enthalpy has decreased considerably to a point b. The liquefied refrigerant in the tubes of each vertical row flows through each capillary tube 30 and undergoes a primary reduction in pressure to an intermediate value as indicated at point c. In this instance, each capillary tube 30 offers resistance to the flow of refrigerant to the extent proportional to the flow rate so that the greater the flow rate the higher the resistance the capillary tube offers to the flow of refrigerant. If there is any differences in flow rate between the tubes of different vertical rows, or refrigerant branch circuits of the main outdoor heat exchanger, a loss of heat transfer efficiency will result. The capillary tubes 30 minimizes such flow rate differences by offering a greater resistance to the higher rate refrigerant flow than that it would otherwise offer to the lower rate refrigerant flow so that there is a plurality of uniform rate flows in the refrigerant circuits of the main outdoor heat exchanger, which increases the heat exchange efficiency of the finned tubes 25 to a maximum.

During cooling operation, the check valve 33 permits free flow of refrigerant through it to the liquid receiver 29 where the refrigerant in liquid phase precipitates so that only the liquid refrigerant is allowed to flow from the bottom of the receiver 29 through pipe 28 to the header 27 of the auxiliary outdoor heat exchanger which acts as a sub-cooler at this time. Therefore, a large volume of refrigerant free from gaseous component required for the larger average cooling load is permitted to flow into the auxiliary outdoor heat exchanger. The refrigerant is sub-cooled by the outdoor air drawn by the fan (not shown) with an attendant decrease in enthalpy to a point d indicated in the Mollier diagram where the sub-cooling effect is maximized since the refrigerant entering the auxiliary exchanger is completely free from the gaseous component. The sub-cooled liquid refrigerant then flows from the header 23 through pipe 24 and through distributor 22 into capillary tubes 21 where it undergoes a secondary reduction in pressure from point d to e in the Mollier diagram. The capillary tubes 21 of the indoor heat exchanger 16, now acting as an evaporator, have the same function as that provided by the capillary tubes 30 of the outdoor heat exchanger 19 acting as condenser at this time so that the refrigerant flows at a uniform rate through the tubes of the vertical rows 20 down to the bottom tubes and thence to the header 15. The uniform rate refrigerant flow in the indoor heat exchanger 16 ensures it to operate at its maximum capability as evaporator. The refrigerant, now in vapor phase, is led into the accumulator 36 by the suction of compressor 10 through pipe 14, reversal valve 13 and pipe 37 and then returns through pipe 35 to the suction side of the compressor 10.

HEATING OPERATION OF FIG. 1

During heating operation, the hot compressed gaseous refrigerant flows from the compressor through the reversal valve 13, tube 14 and header 15 into the bottom tubes of the rows 20 of the indoor heat exchanger 16 (point a′ in Mollier diagram). The indoor heat exchanger 16 at this time acts as a condenser, the indoor air being circulated by a fan, which is not illustrated, over their surfaces, and absorbing the latent heat of vaporization from the refrigerant as it condenses from a gas to a liquid. The refrigerant thus encounters a reduction in enthalpy to a point indicated at b′ in FIG. 2 during the condensation process and flows out the top tubes of the rows 20 into the capillary tubes 21 where the liquefied refrigerant undergoes a primary reduction in pressure from point b′ to point c′. Because of the flow rate control action of the capillary tubes 21, the refrigerant flows at a uniform rate through the tubes of the indoor heat exchanger 16, thus allowing it to operate at its maximum heat transfer capability.

The refrigerant now flows from distributor 22, through pipe 24 and the header 23 into the bottom tubes of the auxiliary outdoor heat exchanger and then out the top tubes of the exchanger into the header 26. The refrigerant is sub-cooled to a point d′ indicated in the Mollier diagram as it flows through the tubes of the auxiliary heat exchanger, and then out the header 26, through pipe 28 into the liquid receiver 29. During heating operation, the check valve 33 blocks the passage of refrigerant so that the liquid in the receiver 29 is now routed through the capillary tube 34. The capillary tube 34 offers a resistance to refrigerant flow so that the refrigerant undergoes a secondary reduction in pressure to a point d'' as indicated in the Mollier diagram.

The air cooling loads are usually much larger than the air heating loads, and if a charge of refrigerant selected for an intermediate air cooling load is supplied during air heating operation to the outdoor heat exchanger acting as an evaporator, the charge of refrigerant will be larger than can be evaporated by the outdoor heat exchanger. The resistance thus provided by the capillary tube 34 limits the supply of refrigerant to the outdoor heat exchanger during heating operation, and permits entry of overflowed of refrigerant to the liquid receiver 29.

The refrigerant now enters the capillary tubes 30 through distributor 31, and undergoes a tertiary reduction in pressure to a point e' indicated in the Mollier diagram as it flows through the tubes 30 and enters the top tubes of the rows 25 of the main outdoor heat exchanger 19 and flows at a uniform rate down to the bottom tubes of the rows 25 into the header 18 from whence it flows through pipe 17, through reversal valve 13 and pipe 37 into the accumulator 36 and back to the suction side of the compressor 10.

During heating operation, the auxiliary outdoor heat exchanger acts as a defroster since it permits flow of relatively hot liquid refrigerant therethrough so that the defroster is maintained at a temperature within a range between 20° C. to 45° C. The heat from the tubes of the auxiliary heat exchanger is most effective during the defrosting operation for melting the heavy block or layer of ice that is liable to have accumulated around the lower portion of the main outdoor heat exchanger which is now acting as an evaporator.

Thus it is seen that the sub-cooling and defrosting operations can be effected by a single auxiliary heat exchanger unit which is constructed integrally with the main outdoor heat exchanger and which is connected in circuit between the main outdoor heat exchanger and the indoor heat exchanger, and that such operations are enhanced in efficiency by connection through the liquid receiver 29 and through a one-way flow resistance means formed by the check valve 33 and the capillary tube 34 in parallel therewith.

Figure 3A:
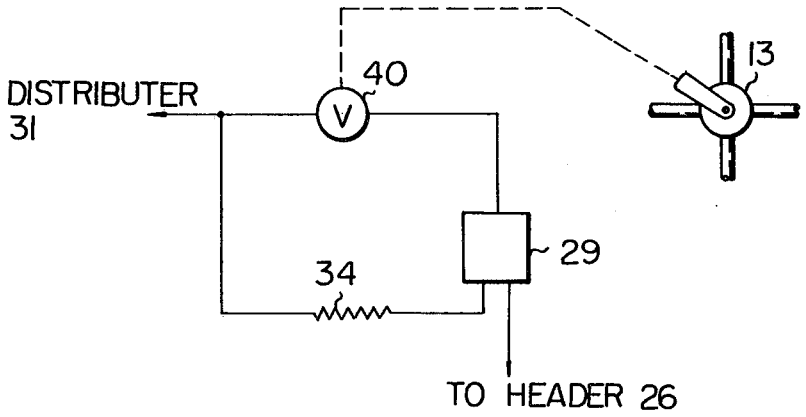
FIGS. 3A and 3B are schematic illustration of modifications of the one-way restricted passage of FIG. 1.
Figure 3B:
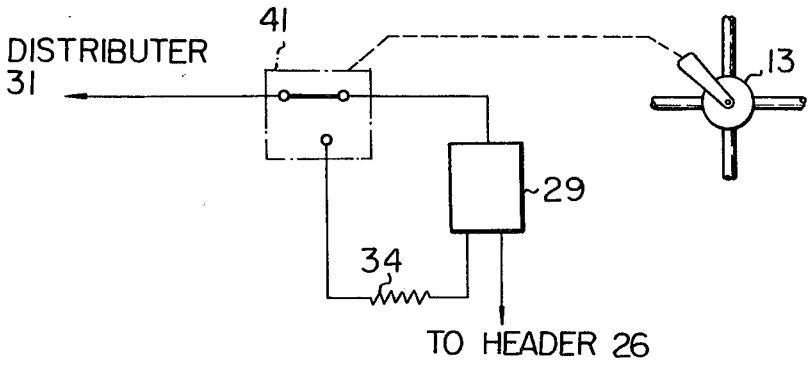

In the above described embodiment check valve 33 is employed to permit free flow of refrigerant only during cooling operation while blocking the passage of refrigerant during heating operation. It is obvious to those skilled in the art to provide the same function by an electromagnetic control valve or manually controlled valve 40 to replace the check valve 33 as illustrated in FIGS. 3A. In this instance, the valve 40 is operated concurrently with the operation of reversal valve 13 to permit free flow of refrigerant during cooling operation while it blocks its passage during heating operation. Alternatively, a three-way valve 41 may be provided in a manner as shown in FIG. 3B in which the valve 41 is operated concurrently with the valve 13 to permit free flow of refrigerant during cooling operation and switches its passage to the capillary tube 34 when the valve 13 is operated to effect heating operation.

During heating operation at relatively high outdoor temperatures, the refrigerant compressor is liable to be overloaded, which could result in thermal decomposition of refrigerant and other undesirable consequences.

Figure 4:
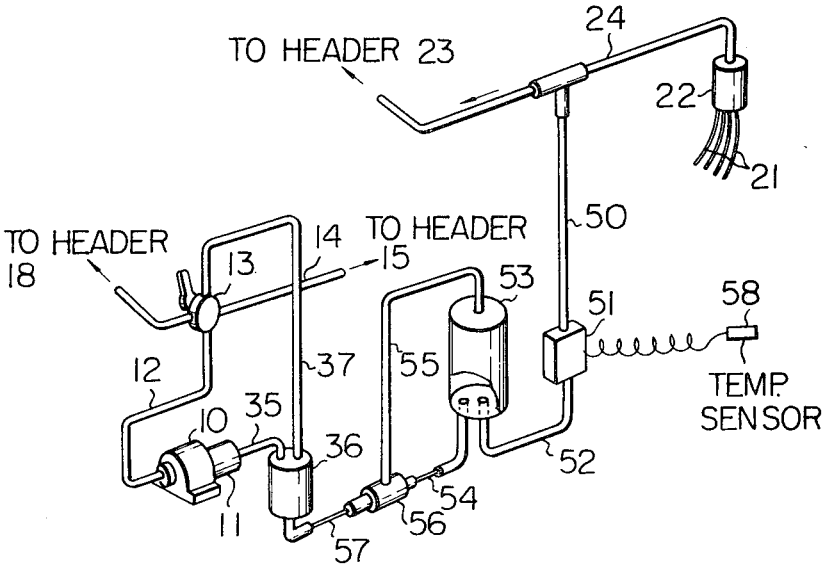
FIG. 4 is a modified embodiment of FIG. 1 which incorporates a by-pass refrigerant flow circuit responsive to an operating parameter of the heat pump.

A modification of FIG. 1 is illustrated in FIG. 4 which is intended to operate the heat pump successfully in a wide range of outdoor temperatures during the winter season. In FIG. 4, the same parts are identified with the same reference numerals as those in FIG. 1, and only the modified portion is illustrated for the sake of brevity. The embodiment of FIG. 4 comprises a by-pass refrigerant flow circuit including a pipe 50 connected to pipe 24 to permit refrigerant flow from the distributor 22 of indoor heat exchanger 16 through an electromagnetic control valve 51 and a pipe 52 into a liquid receiver 53 from whence refrigerant flows through a first capillary tube 54 on the one hand or through a pipe 55 on the other hand, to a joint 56, through a second capillary tube 57 into the accumulator 36. The electromagnetic control valve 51 is operated by a signal from a temperature sensor 58 to open its passage.

During heating operation, the refrigerant that emerges from distributor 24 is partly in liquid phase and partly in gaseous phase, and the mixed phase refrigerant is passed through pipe 24 to the header 23 of the auxiliary outdoor heat exchanger in the direction as indicated by the solid-line arrow. As the outdoor temperature rises, the compressed hot gaseous refrigerant from the discharge side of the compressor 10 rapidly increases both in pressure and in temperature. When a predetermined temperature is reached, the sensor 58 signals the control valve 51 to open so that refrigerant is passed through it and pipe 52 to the liquid receiver 53. From the top of receiver 53 the gaseous refrigerant flows through pipe 55 to the joint 56 and from the bottom of receiver 53 the liquid refrigerant is passed to the joint 56 through the first capillary tube 54 which offers a resistance to the liquid flow so that the flow rate is adjusted automatically to a predetermined intermediate value regardless of the flow rate of entering refrigerant. The mixed liquid and gaseous refrigerant then enters the second capillary tube 57 where the mixed flow rate is automatically adjusted to a value equal to the flow rate of the refrigerant that enters the accumulator 36 through pipe 37.

Figure 5:
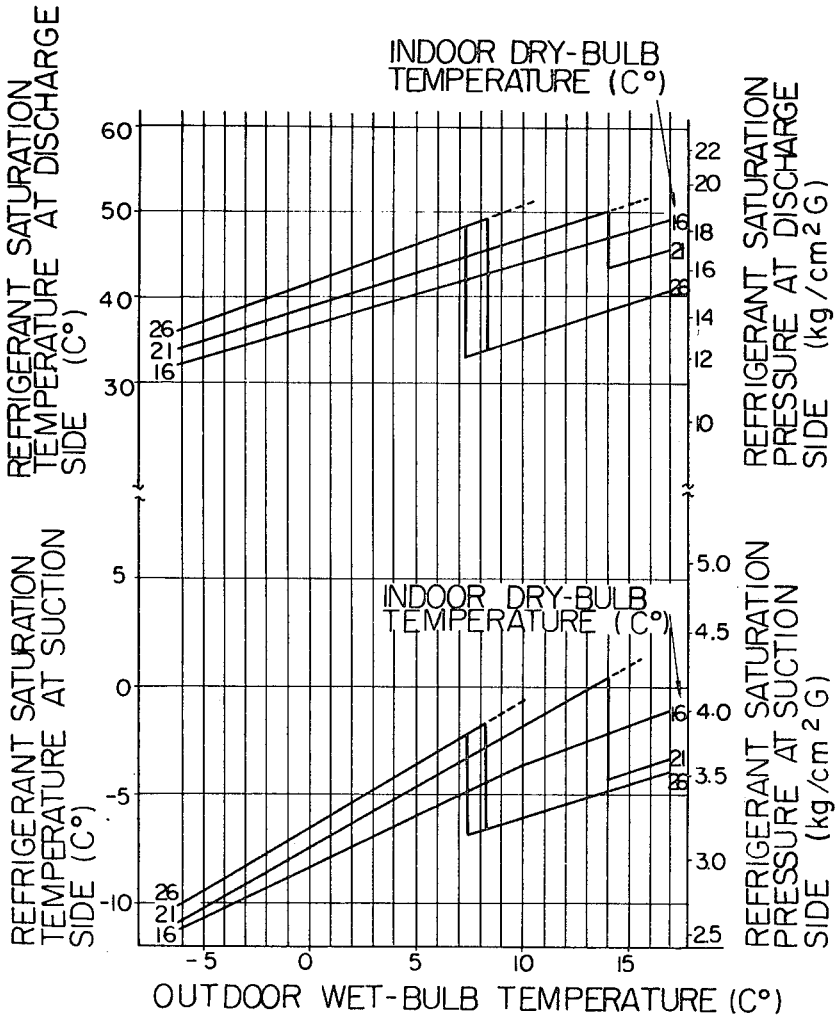
FIGS. 5 and 6 are graphic illustrations of the operating characteristics of the embodiment of FIG. 4.
Figure 6:
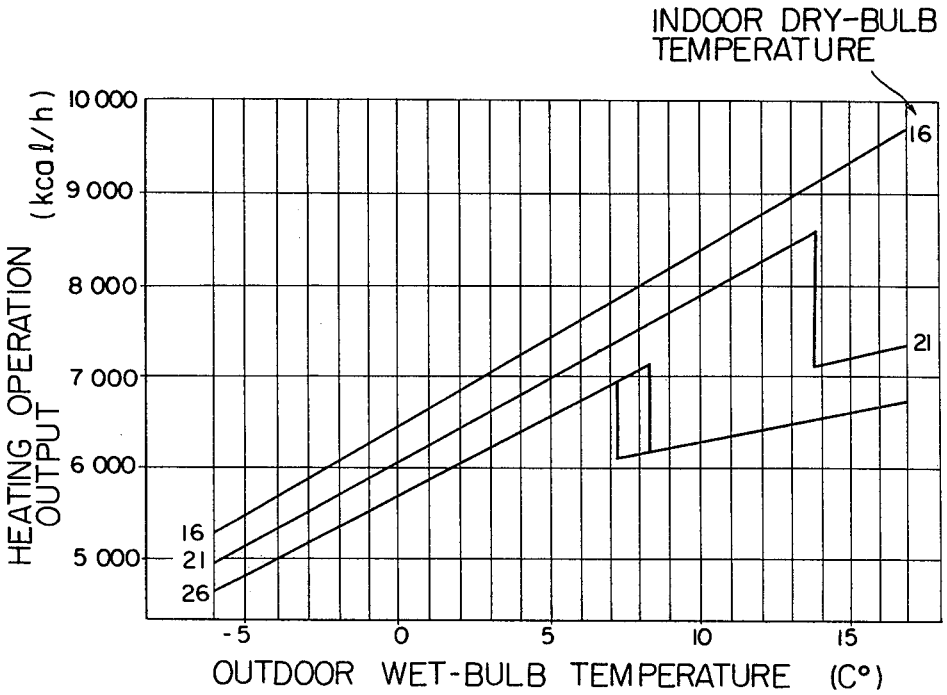

As shown in FIG. 5, when the outdoor temperature reaches approximately 7.5° C. for an indoor temperature of 26° C., refrigerant is routed through the by-pass circuit described above and the saturation temperature of the refrigerant at the suction side of the compressor 10 falls instantly from approximately −2.5° C. to −7° C. and the saturation temperature of the refrigerant at the discharge side falls from approximately 49° C. to 32° C., as well as a decrease in saturation pressure of the refrigerant at both sides of the compressor. Therefore, it is seen that the temperature and pressure of the refrigerant discharged from the compressor 10 is prevented from becoming excessively high during heating operation. During the by-pass operation, the heating operation output correspondingly falls as shown in FIG. 6 from 7,000 kilocalories/hour to approximately 6,000 kilocalories/hour. However, this range of reduction in heating output will not practically affect the operation of the heat pump since heating loads during the by-pass operation are smaller than in relatively cold outdoor conditions.

The temperature sensor 58 may be replaced with a pressure responsive means (not shown) which responds to the pressure of the refrigerant at the discharge side of the compressor 10 when it exceeds a predetermined value indicating the overload condition of the compressor and generates in response thereto a signal that operates the control valve 51.

What is claimed is:

1. A heat pump including a refrigerant compressor, an indoor heat exchanger, a main outdoor heat exchanger, each of said heat exchangers having a plurality of finned parallel tubes, and a refrigerant flow circuit including a reversal valve for routing a refrigerant from said compressor to said indoor heat exchanger during heating operation and routing the refrigerant from said compressor to said main outdoor heat exchanger during cooling operation, comprising:

an auxiliary outdoor heat exchanger having a plurality of finned parallel tubes mounted below said main outdoor heat exchanger and connected in series between said indoor and main outdoor heat exchangers so as to have a higher temperature than said main outdoor heat exchanger to melt any ice which might have formed underneath the main outdoor heat exchanger during the heating operation and to sub-cool the refrigerant during the cooling operation;

first capillary tubes each being respectively connected at one end to a respective one of said finned tubes of said main outdoor heat exchanger;

a one-way valve and a liquid receiver respectively connected in series between the other end of said first capillary tubes and said finned tubes of the auxiliary outdoor heat exchanger, said one-way valve permitting the passage of refrigerant from said main heat exchanger to said liquid receiver during the cooling operation and preventing the passage of refrigerant from said liquid receiver during the heating operation;

a second capillary tube connected to provide a bypass passage for the refrigerant from said liquid receiver during the heating operation to said main outdoor heat exchanger; and third capillary tubes each being respectively connected at one end to a respective one of the finned tubes of said indoor heat exchanger and connected at the other end to said auxiliary outdoor heat exchanger.

2. A heat pump as claimed in claim 1, wherein said one-way valve is connected to the top wall of said liquid receiver and said second capillary tube is connected between the bottom wall of said liquid receiver and a junction between said one-way valve and said first capillary tubes.

3. A heat pump as claim in claim 1, further comprising means operative during said heating operation for sensing an operating parameter of said heat pump indicating that the compressor is overloaded, pressure reduction means and a bypass circuit responsive to said sensing means for passing certain of said refrigerant from a portion of said refrigerant flow circuit between said indoor and auxiliary outdoor heat exchangers to the suction side of said compressor through said pressure reduction means.

4. A heat pump as claimed in claim 3, wherein said by-pass circuit comprises a second liquid receiver and a means including a control valve responsive to said sensing means for passing said refrigerant from said portion of the refrigerant circuit into said second liquid receiver through the bottom wall thereof, and wherein said pressure reduction means comprises a first capillary tube connected at one end to the second liquid receiver through the bottom wall thereof and at the other end to a junction point, means for communicating the refrigerant in said second liquid receiver from the top wall thereof to said junction point and a second capillary tube connected at one end to said junction point and communicated at the other end to the suction side of said compressor through an accumulator.

5. A heat pump including a refrigerant compressor, an indoor heat exchanger coil, a main outdoor heat exchanger coil, and a refrigerant flow circuit including a reversal valve for routing the refrigerant from said compressor to said indoor heat exchanger coil during heating operation and routing the refrigerant from said compressor to said main outdoor heat exchanger coil during cooling operation, comprising:

an auxiliary outdoor heat exchanger coil mounted below said main outdoor heat exchanger coil and connected in a series refrigerant flow circuit between said indoor and main outdoor heat exchanger coils so as to have a higher temperature than said main outdoor heat exchanger coil to melt any ice which might have formed underneath the main outdoor heat exchanger coil during the heating operation and to sub-cool the refrigerant during the cooling operation;

first pressure reduction means, one-way second pressure reduction means and a liquid receiver connected respectively in series between said main outdoor heat exchanger coil and said auxiliary outdoor heat exchanger coil; and third pressure reduction means connected between said auxiliary outdoor heat exchanger coil and said indoor heat exchanger coil.

6. A heat pump as claimed in claim 5, wherein each of said first, second and third pressure reduction means comprises a capillary tube.

7. A heat pump as claimed in claim 5, wherein said one-way pressure reduction means comprises a one-way valve and a capillary tube connected at one end to a junction and thence to said first pressure reduction means and connected respectively at the other end to the top and bottom walls of said liquid receiver.

8. A heat pump as claimed in claim 5, further comprising means operative during the heating operation for sensing an operating parameter of said heat pump indicating that the compressor is overloaded, fourth pressure reduction means and a by-pass circuit responsive to said sensing means for passing certain of the refrigerant from a portion of said refrigerant flow circuit between said indoor and auxiliary outdoor heat exchangers to the suction side of said compressor through said fourth pressure reduction means.

9. A heat pump as claimed in claim 8, wherein said by-pass circuit comprises a second liquid receiver and means including a control valve responsive to said sensing means for passing said refrigerant from said portion of the refrigerant circuit into said second liquid receiver through the bottom wall thereof, and wherein said fourth pressure reduction means comprises a first capillary tube connected at one end to the liquid receiver through the bottom wall thereof and at the other end to a junction point, means for communicating the refrigerant in said second liquid receiver from the top wall thereof to said junction point and a second capillary tube connected at one end to said junction point and communicated at the other end to the suction side of said compressor through an accumulator.

* * * * *